US010961853B2

(12) United States Patent
Cox

(10) Patent No.: US 10,961,853 B2
(45) Date of Patent: Mar. 30, 2021

(54) SPIGOT ASSEMBLY FOR ROTATING COMPONENTS

(71) Applicant: PRATT & WHITNEY CANADA CORP., Longueuil (CA)

(72) Inventor: Edward Cox, Oakville (CA)

(73) Assignee: PRATT & WHITNEY CANADA CORP., Longueuil (CA)

( * ) Notice: Subject to any disclaimer, the term of this patent is extended or adjusted under 35 U.S.C. 154(b) by 167 days.

(21) Appl. No.: 16/128,950

(22) Filed: Sep. 12, 2018

(65) Prior Publication Data

US 2020/0040734 A1 Feb. 6, 2020

Related U.S. Application Data

(60) Provisional application No. 62/712,261, filed on Jul. 31, 2018.

(51) Int. Cl.
*F01D 11/00* (2006.01)
*F01D 5/04* (2006.01)

(52) U.S. Cl.
CPC ..... *F01D 5/048* (2013.01); *F01D 11/00* (2013.01); *F05D 2220/32* (2013.01); *F05D 2260/941* (2013.01)

(58) Field of Classification Search
CPC ..... F01D 11/001; F01D 11/006; F01D 5/04; F01D 5/043; F01D 5/048
See application file for complete search history.

(56) References Cited

U.S. PATENT DOCUMENTS

| | | | | |
|---|---|---|---|---|
| 4,017,209 | A * | 4/1977 | Bodman | F01D 5/3084 416/97 R |
| 7,156,612 | B2 | 1/2007 | Warikoo et al. | |
| 7,287,961 | B2 * | 10/2007 | Broadhead | F01D 5/02 416/220 R |
| 9,284,847 | B2 * | 3/2016 | Belmonte | F01D 5/3015 |
| 10,184,345 | B2 * | 1/2019 | Himes | F01D 5/3015 |

FOREIGN PATENT DOCUMENTS

EP 3296524 A1 3/2018

* cited by examiner

*Primary Examiner* — Justin D Seabe
(74) *Attorney, Agent, or Firm* — Norton Rose Fulbright Canada LLP

(57) ABSTRACT

A spigot joint between two rotating components of a gas turbine engine comprises a male portion engaged with a female portion. The male portion has a radially outer finger spring-loaded against a surrounding surface of the female portion, and a radially inner finger spaced from the radially outer finger by a gap.

16 Claims, 4 Drawing Sheets

SPIGOT ASSEMBLY FOR ROTATING COMPONENTS

CROSS-REFERENCE TO RELATED APPLICATIONS

This application claims priority from U.S. provisional patent application No. 62/712,261, filed Jul. 31, 2018, the entire content of each of which is incorporated by reference herein.

TECHNICAL FIELD

The application relates generally to gas turbine engines and, more particularly, to a spigot assembly between two rotating components.

BACKGROUND OF THE ART

The spigoted fit between two rotating components during operation is affected by centrifugal forces as well as thermal growth forces. The centrifugal forces are directly related to rotational speeds, while the thermal growth forces are related to the temperature profiles of the two components. The magnitude of the thermal growth forces can be exacerbated by material property differences, such as the coefficient of thermal expansion and the modulus of elasticity, between the two spigoted components. Prior technology typically requires a looser fit at certain operating conditions in order to avoid having to deal with excessively high steady-state stresses that would otherwise occur with a continuous tight fit design between two rotating components. However, a loose fit allows for greater component deflection, which subsequently enables greater vibratory strains/stresses to be induced by modal excitations at certain operating conditions. Heretofore, compromises had to be made to tentatively accommodate these two opposed requirements.

Improvements are thus desirable.

SUMMARY

In one aspect, there is provided an assembly of rotating components for a gas turbine engine, the assembly comprising: a first rotating component and a second rotating component jointly rotatable about a common axis, the first rotating component having a male portion, the second rotating component having a female portion, the male portion engaged with the female portion, the male portion having a radially outer finger biased against a surrounding radially inwardly facing surface of the female portion and a radially inner finger configured to deflect radially outwardly in bearing contact with the radially outer finger in response to centrifugal forces exerted on the first rotating component and the second rotating component during high power engine operating conditions.

In accordance with another aspect, there is provided an assembly of rotating components for a gas turbine engine, the assembly comprising: a first rotating component and a second rotating component jointly rotatable about a common axis, the first rotating component having a male portion, the second rotating component having a female portion, the male portion engaged with the female portion, the male portion having a radially outer finger biased against a surrounding radially inwardly facing surface of the female portion and a radially inner finger deflectable outwardly under centrifugal forces/thermal growth in bearing contact with the radially outer finger.

In another aspect, there is provided a spigot joint between two rotating components of a gas turbine engine, the two rotating components being mounted for rotation about an axis, the spigot joint comprising: a male portion engaged with a female portion, the male portion comprising a radially outer finger spring-loaded against a surrounding radially inwardly facing surface of the female portion, and a radially inner finger spaced from the radially outer finger by a gap.

In a further aspect, there is provided a method of reducing stress levels at a male/female interface of a spigot joint between a first and a second rotating component of a gas turbine engine, the method comprising: creating two different load paths at the male/female interface, the load paths changing as a function of engine operating conditions.

DESCRIPTION OF THE DRAWINGS

Reference is now made to the accompanying figures in which.

DETAILED DESCRIPTION

Figure 1:
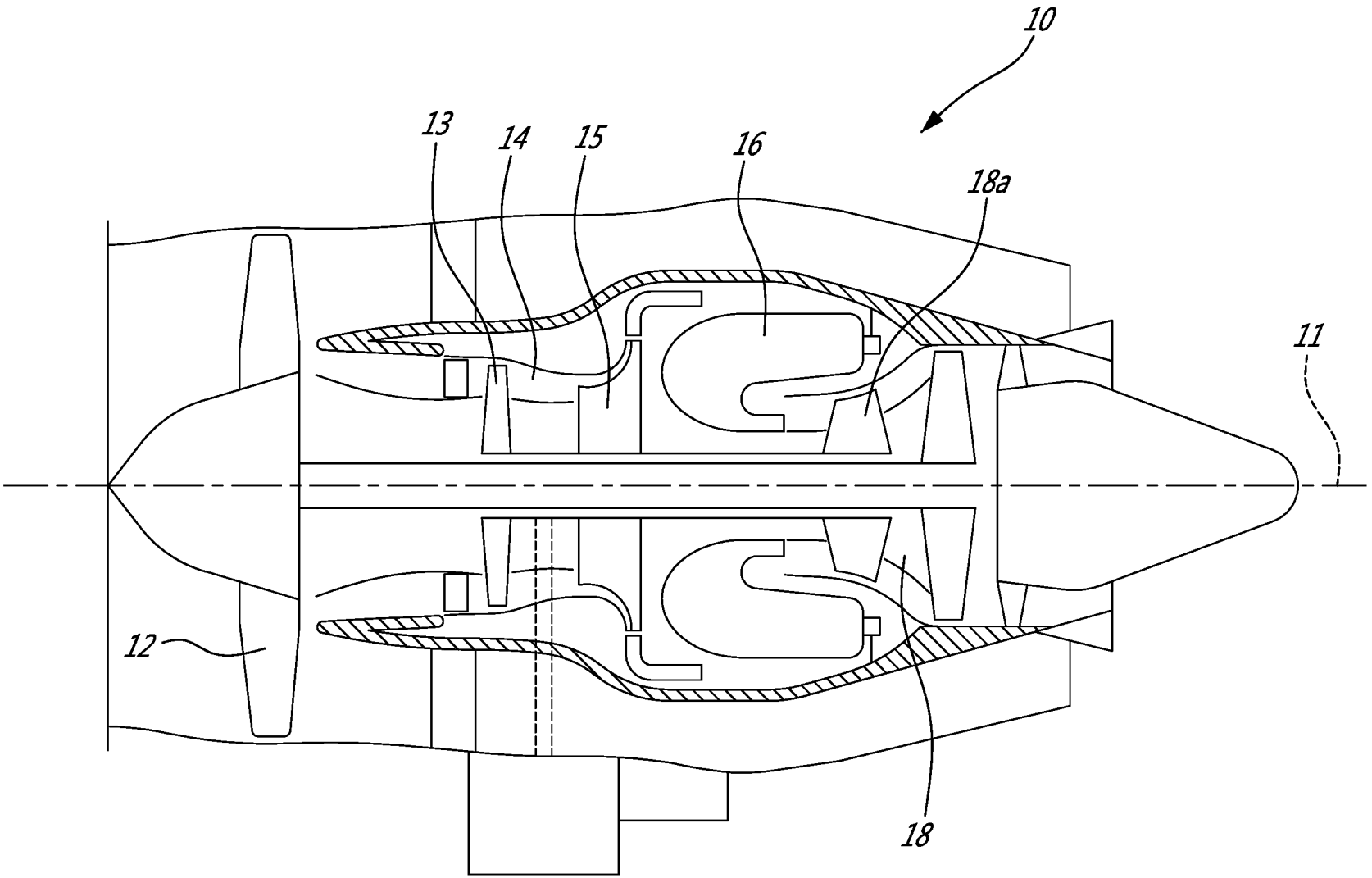
FIG. 1 is a schematic cross-section view of a gas turbine engine.

FIG. 1 illustrates a turbofan gas turbine engine 10 of a type preferably provided for use in subsonic flight, generally comprising in serial flow communication a fan 12 through which ambient air is propelled, a multistage compressor section 14 for pressurizing the air, a combustor 16 in which the compressed air is mixed with fuel and ignited for generating an annular stream of hot combustion gases, and a turbine section 18 for extracting energy from the combustion gases. The compressor section 14 and the turbine section 18 have respective rotors mounted for rotation about the center axis 11 of the engine.

Figure 2:
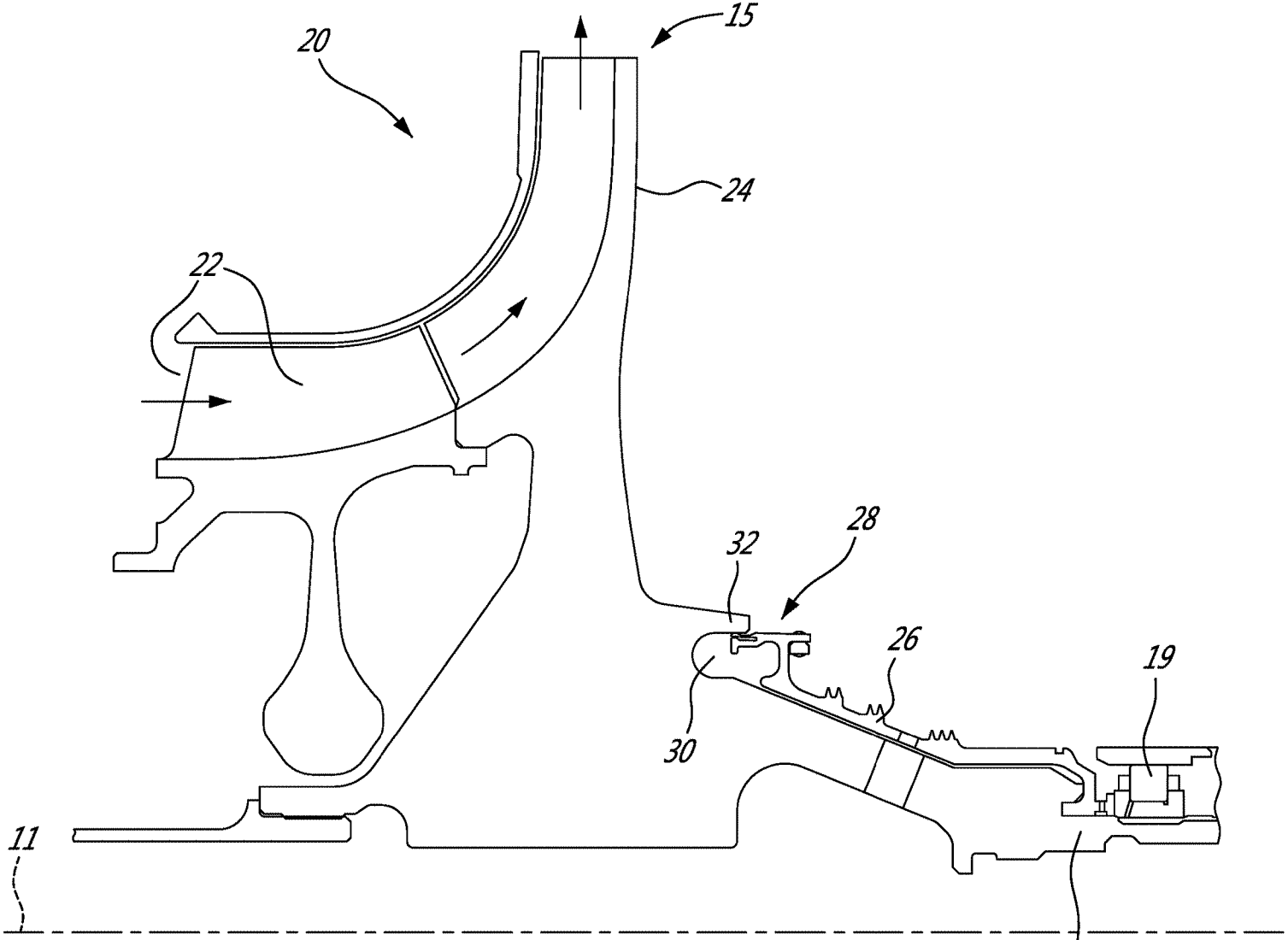
FIG. 2 is a schematic cross-section view of an impeller rotor assembly of a compressor section of the engine shown in FIG. 1.

The multistage compressor section 14 comprises an axial compressor 13 and a centrifugal compressor 15. As best shown in FIG. 2, the centrifugal compressor 15 has an impeller 20 comprising an inducer 22 having an axial inlet, and an exducer 24 having a radial outlet. The inducer 22 and the exducer 24 are mounted for joint rotation with a high pressure turbine 18*a* of the turbine section 18 about axis 11 (the impeller inducer 22 and the impeller exducer 24 are thus components of the engine high pressure spool). The exducer 24 has a rearwardly axially extending shaft portion 24*a*, which is rotatably supported by a bearing 19 disposed axially aft of the radial outlet of the exducer 24. The bearing 19 has a front seal runner 26, which is mounted for rotation with the impeller 20 (and which is thus also a component of the high pressure spool). As can be appreciated from FIG. 2, a spigot joint is provided between the exducer 24 and seal runner 26. More particularly, the seal runner 26 has a male portion 28 mating with a corresponding female portion 30 on the exducer 24. According to the illustrated example, the female portion 30 takes the form of an annular recess circumscribed by a rear hook 32 projecting axially rearwardly from a hub portion of the exducer 24. The male portion 28 of the seal runner 26 extends axially in the annular recess underneath the rear hook 32. Both the male portion 28 and the rear hook 32 have an annular configuration, the male portion 28 being sized to fit within the rear hook 32.

The durability of the seal runner 26 and the exducer 24 is affected by the combination of steady-state (Low Cycle Fatigue) stress levels and vibratory (High Cycle Fatigue) stress levels. LCF stresses typically increase as the spigot interface fit between the seal runner 26 and the exducer 24 becomes tighter. For this reason, the fit between the male portion 28 and the female portion 30 of the spigot joint is typically designed to be loose at assembly and at low rotational speeds/cold engine operating conditions, in order to avoid very high steady-state stresses resulting from thermal/centrifugal induced forces at high rotational speed/hot engine operating conditions. The fit will typically become looser through use, due to relative motion, as wear occurs between the two rotating components (i.e. the exducer and the seal runner).

On the other hand, HCF stresses typically increase as the interface becomes looser, because the looser fit allows for greater component deflection, and subsequently greater vibratory strains/stresses induced by modal excitations at certain operating conditions.

Figure 3:
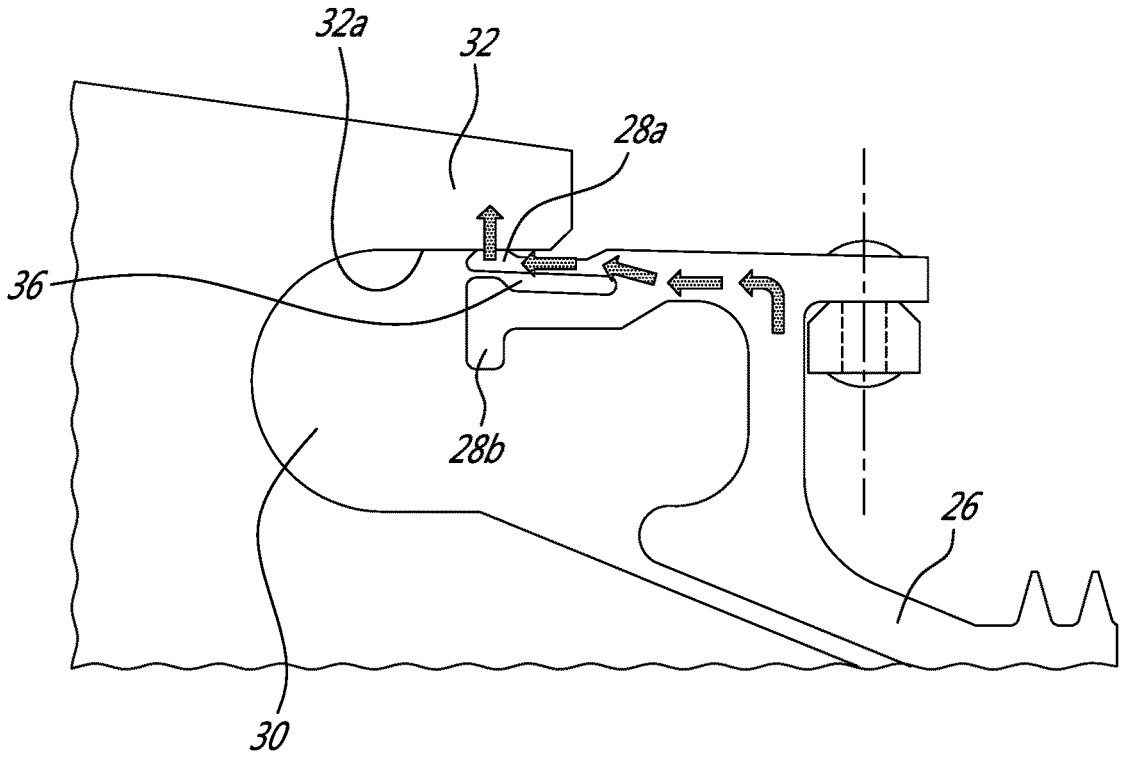
FIG. 3 is an enlarged schematic cross-section view illustrating a spigot assembly between two rotating components, namely the impeller exducer and a bearing front seal runner at assembly and low speed/cold operating engine conditions.
Figure 4:
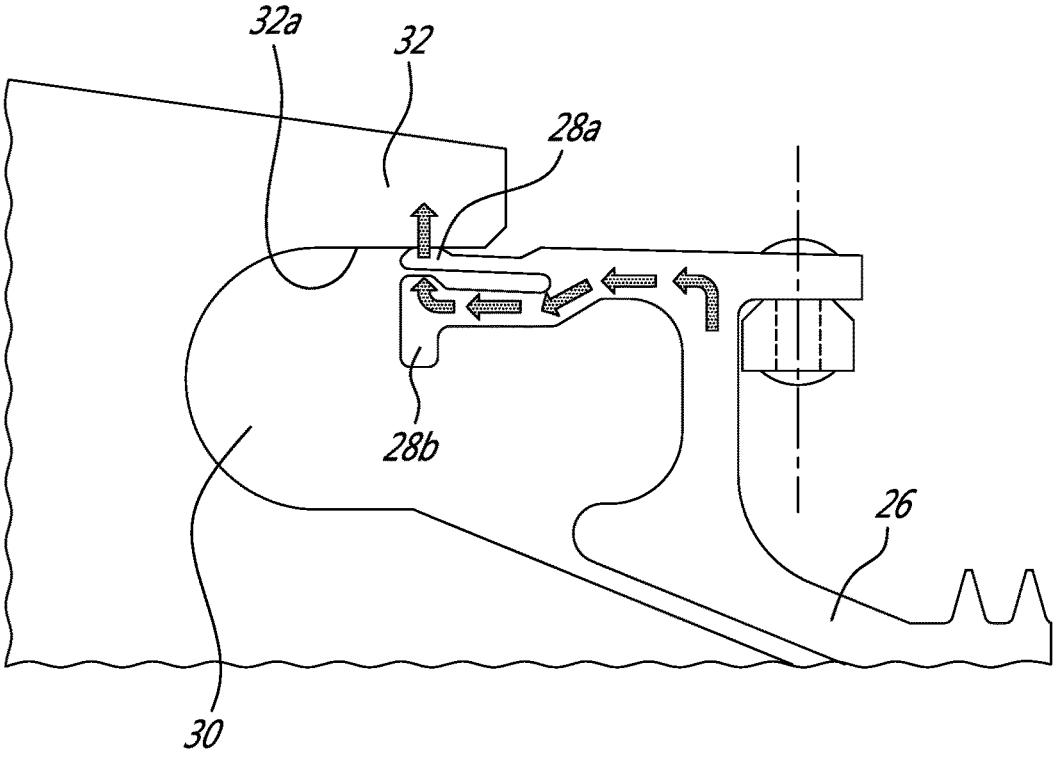
FIG. 4 is an enlarged schematic cross-section view of the spigot assembly illustrating the behavior of the male portion of the spigot assembly under high power/temperature engine operating conditions.

According to the embodiment shown in FIGS. 2 to 4, the above LCF and HCF concerns may be addressed by the provision of a sprung spigot design, which on the one hand enables full contact to occur at all engine operating conditions so as to minimize the magnitude of vibratory stresses that are induced in the components, and on the other hand accommodates the fact that significant centrifugal and thermal loads will be induced at higher power engine operating conditions (must not overload the rear hook 32 of the exducer 24).

As shown in FIG. 3, the sprung spigot design may incorporate a two-prong geometry of the male portion 28 of the seal runner 26. More particularly, the male portion 28 may comprise a radially outer finger 28*a* and a radially inner finger 28*b* spaced apart on build by an axially extending annular gap 36. The outer finger 28*a* is configured to exhibit flexibility/resiliency and is made to a slightly larger diameter than the inner diameter of the rear hook 32 of the inducer 24 so that when the male portion 28 is axially inserted in the female portion 30 of the exducer 24, the outer finger 28*a* springs in place in an inwardly deflected state against the radially inwardly facing surface 32*a* of the rear hook 32. At assembly, the outer finger 28*a* is, thus, spring-loaded radially outwardly in contact against the radially inwardly facing surface 32*a* of the rear hook 32. In other words, the sprung outer finger 28*a* allows having a tight fit on build and at low power operating conditions while not overloading the rear hook 32 at high power operating engine conditions. "Spring loading" is designed to allow for tight fit at all conditions for the useful life of the parts-even with exducer wear. As shown in FIG. 3, the outer finger 28*a* is made thinner and more flexible than the inner finger 28*b* to provide the desired flexibility/resiliency. The sprung finger 28*a* allows for a relatively light loading of the rear hook 32 on build and at low rpm/cold engine operations. It is noted that the flexibility of the outer finger 28*a* can be improved by circumferentially segmenting the outer finger 28*a* to further address loading resulting from thermally induced hoop stresses. For instance, the outer finger 28*a* could be composed of 4 circumferential segments. To that end, axial slots could be defined in the outer finger 28*a* at predetermined locations around the circumference thereof.

As shown in FIG. 3, at assembly and low rotational speeds/cold engine operating conditions, the "beefier" and more rigid inner finger 28*b* is radially spaced from the outer finger 28*a* by the gap 36 and, thus, all the loads transferred to the exducer rear hook 32 are through the thinner spring-loaded outer finger 32. However, as shown in FIG. 4, at high rotational speed/hot engine operating conditions, the inner finger 28*b* or hoop will grow out in direct contact with the outer finger 28*a*, thereby closing the gap 36. From FIG. 4, it can be appreciated that the hammer-shaped distal end of the inner finger 28*b* is in bearing contact with the corresponding thickened distal end of the outer finger 28*a*. This provides for a different load path where loads are now transferred from the inner finger 28*b* to the rear hook 32 via the outer finger 28*a*. There are thus two different load paths, which change essentially based on the inner finger 28*b* centrifugal and thermal growth out against the outer sprung finger 28*a*.

The gap 36 is sized to allow for normal growth to high power/temperature conditions without overloading the exducer rear hook 32. In other words, the gap 36 is designed and radially sized to accommodate some of the thermal and centrifugal growth so as to not overload the exducer rear hook 32 during high power engine operating conditions.

It can be appreciated from the foregoing that the spring loaded finger 28*a* addresses HCF by providing full contact at all conditions and that the gap 36 addresses LCF life with reduced max steady-state loads.

In summary, it can be said that the sprung outer finger 28*a* provides the benefit of simultaneously allowing for low LCF stresses (that are similar to a looser fit design configuration), while always maintaining contact at the interface to prevent high vibratory strains/stresses from being induced. The sprung outer finger 28*a* also serves the purpose of lightly loading the components at these conditions, to influence them to remain concentric for improved engine balance. The sprung finger 28*a* is also intended to ensure that the 2 components (i.e. the exducer rear hook 32 and the male portion 28 of the runner 26) are always in contact, for all operating conditions, and for the life of the components, because the sprung outer finger 28*a* will expand as required to remain in contact even as the gap between the components increases over time due to wear. On the other hand, the inner finger 28*b* and the gap 36 enable the load path between the two components to shift to a more traditional configuration under higher centrifugal forces/thermal growth, without inducing unacceptably high steady-state stresses at these conditions.

More generally, the described two-prong geometry at the male/female interface of the rotating components may allow to improve component durability by always maintaining at least a 'contact' fit between the rotating components via the thin sprung outer finger 28*a* to thereby minimize vibratory induced stresses without causing excessively high steady-state stresses by the accommodation of at least some of the thermal and centrifugal growth in gap 36. Indeed, according to at least some embodiments, the male spigot geometry enables full contact to occur at all engine operating conditions, throughout the life of the component while preventing overloading at high power engine operating conditions, the continuous contact serving to minimize the magnitude of vibratory stresses that are induced in the component, thereby resulting in improved component durability through an optimization of both vibratory and steady-state stresses on the rotating components.

Figure 5:
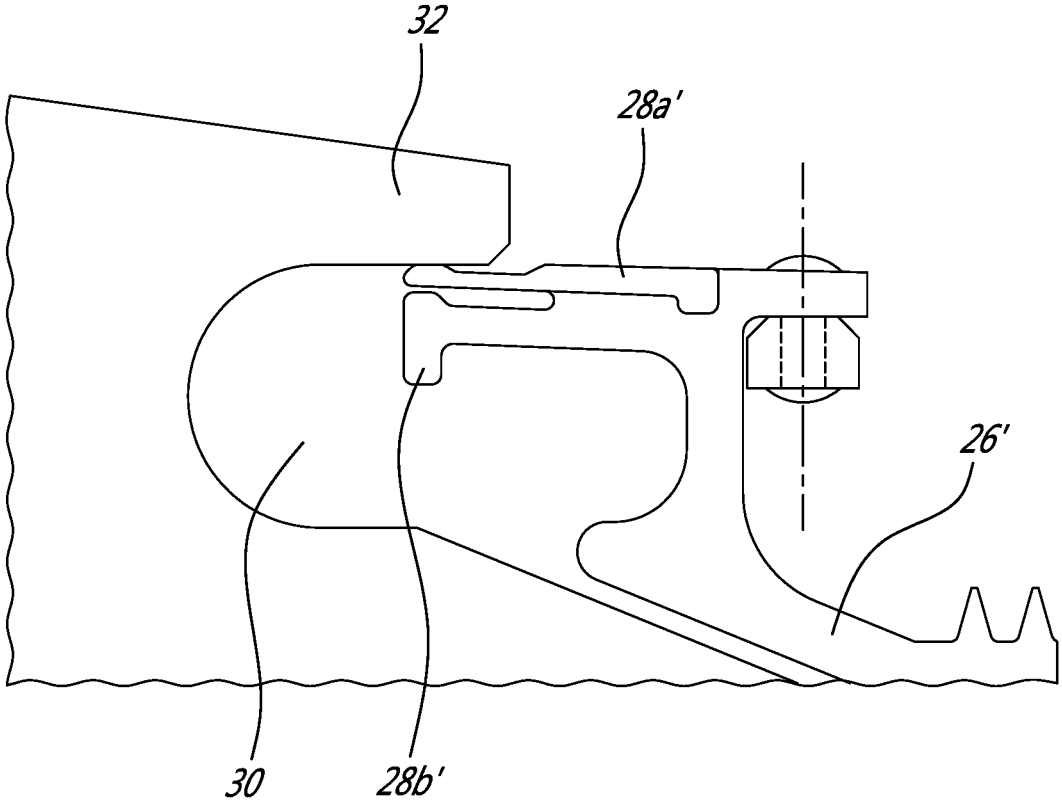
FIG. 5 is an enlarged schematic cross-section view illustrating an example of a more detailed construction of the male portion of the spigot assembly.

The male portion 28 can be of unitary construction or it can be assembled from different parts. FIG. 5 illustrates one example, where the outer finger 28*a*' is a separate part assembled to the front end of the runner 26' over the inner finger 28*b*'. The outer finger 28*a*' can, for instance, be provided in the form of a sleeve welded, brazed, riveted or otherwise suitably fastened or joined at its proximal end to the seal runner body in a cantilevered fashion.

The above description is meant to be exemplary only, and one skilled in the art will recognize that changes may be made to the embodiments described without departing from the scope of the invention disclosed. For example, while the exemplified spigot joint has been described in the context of an impeller exducer and a seal runner, it is understood that other applications are possible. In fact, any combination of the various aspects described above could be used in any locations where there are steady state and high cycle fatigue concerns and overload risks at the interface between two rotating components of a gas turbine engine. Also, the outer finger could be biased radially outwardly by various external means, such as a spring or the like. Still other modifications which fall within the scope of the present invention will be apparent to those skilled in the art, in light of a review of this disclosure, and such modifications are intended to fall within the appended claims.

The invention claimed is:

1. An assembly of rotating components for a gas turbine engine, the assembly comprising: a first rotating component and a second rotating component jointly rotatable about a common axis, the first rotating component having a male portion, the second rotating component having a female portion, the male portion engaged with the female portion and cooperating therewith to form a low power load path and a high power load path changing as a function of engine operating conditions, the male portion having a radially outer finger biased against a surrounding radially inwardly facing surface of the female portion and a radially inner finger configured to deflect radially outwardly in bearing contact with the radially outer finger to activate the high power load path in response to centrifugal forces exerted on the first rotating component and the second rotating component during high power engine operating conditions, wherein for the high power load path, loads are transferred from the radially inner finger to the female portion through the radially outer finger, and wherein for the low power load path, the radially inner finger does not transfer any loads to the radially outer finger, the loads are rather exclusively transferred from the male portion to the female portion via the radially outer finger.

2. The assembly defined in claim 1, wherein at assembly, the radially outer finger is spaced from the radially inner finger by a gap, the gap configured to accommodate at least a portion of thermal and centrifugal growth of the radially inner finger during engine operations.

3. The assembly defined in claim 2, wherein the gap extends circumferentially between the radially outer finger and the radially inner finger, the gap having an axially open end at assembly.

4. The assembly defined in claim 1, wherein the radially outer finger has an initial diameter at rest which is greater than a diameter of the radially inwardly facing surface of the female portion, the radially outer finger being radially inwardly deflectable in a compressed state upon axial insertion into the female portion.

5. The assembly defined in claim 1, wherein the first rotating component is a seal runner, and wherein the second rotating component is an impeller exducer, the male portion of the seal runner mating with the female portion of the impeller exducer.

6. The assembly defined in claim 5, wherein the female portion of the impeller exducer comprises an annular rear hook projecting axially rearwardly from a rear facing side of a hub of the impeller exducer.

7. The assembly defined in claim 1, wherein the radially outer finger exhibits greater flexibility than the radially inner finger.

8. The assembly defined in claim 7, wherein the first rotating component has a body, the body and the radially inner finger being of unitary construction, and wherein the radially outer finger is assembled to the body of the first rotating component over the radially inner finger.

9. A spigot joint between two rotating components of a gas turbine engine, the two rotating components being mounted for rotation about an axis, the spigot joint comprising: a male portion engaged with a female portion, the male portion comprising a radially outer finger biased against a surrounding radially inwardly facing surface of the female portion to form a low power load path, and a radially inner finger spaced from the radially outer finger by a gap, wherein the radially inner finger is configured to deflect into contact with the radially outer finger under centrifugal and thermal loads during engine operation to create a high power load path, wherein for the high power load path, loads are transferred from the radially inner finger to the female portion through the radially outer finger, and wherein for the low power load path, the radially inner finger does not transfer any loads to the radially outer finger, the loads are rather exclusively transferred from the male portion to the female portion via the radially outer finger.

10. The spigot joint defined in claim 9, wherein the gap is configured to accommodate at least a portion of thermal and centrifugal growth of the radially inner finger during engine operation.

11. The spigot joint defined in claim 9, wherein the gap extends circumferentially between the radially outer finger and the radially inner finger, the gap having an axially open end at assembly.

12. The spigot joint defined in claim 9, wherein the radially outer finger has an initial diameter at rest which is greater than a diameter of the radially inwardly facing surface of the female portion, the radially outer finger being radially inwardly deflectable in a compressed state upon axial insertion into the female portion.

13. The spigot joint defined in claim 9, wherein the radially outer finger exhibits greater flexibility than the radially inner finger.

14. A method of reducing stress levels at a male/female interface of a spigot joint between a first and a second rotating component of a gas turbine engine, the spigot joint having a male portion engaged with a female portion, the male portion having a radially outer finger and a radially inner finger, the method comprising:

creating two different load paths at the male/female interface, the load paths changing as a function of engine operating conditions, the two different load paths including a low power load path and a high power load path, wherein for the high power load path, loads are transferred from the radially inner finger to the female portion through the radially outer finger; and biasing the radially outer finger against a surrounding surface of the female portion, wherein for the low power load path, the radially inner finger does not transfer any loads to the radially outer finger.

15. The method defined in claim 14, wherein the load path changes as a result of the radially inner finger being pushed out by a centrifuged force against the radially outer finger.

16. The method defined in claim 14, wherein for the low power load path, loads are exclusively transferred from the male portion to the female portion via the radially outer finger.

* * * * *